US010787002B1

(12) United States Patent
Liu et al.

(10) Patent No.: US 10,787,002 B1
(45) **Date of Patent: *Sep. 29, 2020**

(54) SYSTEM AND DEVICE FOR ATTENUATING CURL IN SUBSTRATES PRINTED BY INKJET PRINTERS

(71) Applicant: Xerox Corporation, Norwalk, CT (US)

(72) Inventors: Chu-Heng Liu, Penfield, NY (US); Douglas K. Herrmann, Webster, NY (US); Seemit Praharaj, Webster, NY (US); Paul J. McConville, Webster, NY (US); Jason M. LeFevre, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/406,520

(22) Filed: May 8, 2019

(51) Int. Cl.
*B41J 11/00* (2006.01)
*B41M 5/00* (2006.01)

(52) U.S. Cl.
CPC ..... *B41J 11/0005* (2013.01); *B41J 11/002* (2013.01); *B41M 5/0017* (2013.01)

(58) Field of Classification Search
CPC ..... B41J 11/0015; B41J 11/002; B41J 2/01
USPC ..... 347/16, 101–103
See application file for complete search history.

(56) References Cited

U.S. PATENT DOCUMENTS

| | | | | |
|---|---|---|---|---|
| 2,022,593 | A | 11/1935 | Fuykers | |
| 4,697,514 | A | 10/1987 | George et al. | |
| 5,371,531 | A | 12/1994 | Rezanka et al. | |
| 5,764,263 | A | 6/1998 | Lin | |
| 6,076,921 | A | 6/2000 | Rezanka et al. | |
| 6,132,038 | A | 10/2000 | Szlucha | |
| 6,428,160 | B2 | 8/2002 | Roy et al. | |
| 6,799,759 | B1 | 10/2004 | McNamara et al. | |
| 8,038,280 | B2 | 10/2011 | Scarlata | |
| 9,403,358 | B1 * | 8/2016 | Ferrara, Jr. | B41J 11/0015 |
| 10,350,912 | B1 * | 7/2019 | Herrmann | B41J 13/106 |
| 2007/0021905 | A1 | 1/2007 | Lim | |
| 2011/0050824 | A1 | 3/2011 | Toya et al. | |
| 2017/0087874 | A1 | 3/2017 | Maida | |

* cited by examiner

*Primary Examiner* — An H Do
(74) *Attorney, Agent, or Firm* — Maginot Moore & Beck LLP

(57) ABSTRACT

An aqueous ink printer includes an anti-curl fluid applicator that applies anti-curl fluid to a side of a substrate that is opposite a side that bears or will bear an ink image. The anti-curl fluid applicator includes a switching network that is configured to independently and selectively bias segments of a pressure member electrically. The segments are arranged along a longitudinal axis of the pressure member. The pressure member forms a nip with a anilox roller partially immersed in a reservoir of anti-curl fluid. As the switching network is operationed to selectively and independently bias the segments electrically using data corresponding to the ink image, anti-curl fluid migrates from the anilox roller onto the substrate in areas opposite the electrically biased segments.

21 Claims, 2 Drawing Sheets

SYSTEM AND DEVICE FOR ATTENUATING CURL IN SUBSTRATES PRINTED BY INKJET PRINTERS

TECHNICAL FIELD

This disclosure relates generally to inkjet printing systems, and more particularly, to addressing curl produced in substrates printed by such printers.

BACKGROUND

Inkjet printing systems form images on substrates with drops of ink. Whether an image is printed directly onto a substrate or transferred from a blanket configured about an intermediate transfer member, once the image is on the substrate, the water and other solvents in the ink begin to be absorbed by the substrate. Eventually, the water and other solvents are removed from the surface by drying the image. During manufacture of fibrous substrates, such as paper substrates, the substrates are strenched and then dried. The extensional stretch is fixed in the substrates by the drying. When the substrate is wetted again during printing, the extensional stretch is released. Subsequent drying of the substrate can cause the substrate to shrink from its pre-printing dimensions. These issues are particularly apparent in printers that form images with aqueous inks. The water in these inks release the extensional stress. Even after the substrates are dried after printing, humectants and some moisture remain in the substrates and can continue to shrink the substrates for even days after the printing of the substrates. Although practically all of the moisture and humectants eventually leave the substrate, the shrinkage that occurs before this level of dryness is reached can cause the substrates to curl. In some cases, the magnitude of the curl can be significant and persistent. As the curled substrates fill the output tray, this unevenness can present issues for stacking the printed substrates in the tray and the degree of unevenness in the surface of the substrates can impact the desirability of the printed sheets for the user. Being able to retain the original size and flatness of the substrates after inkjet printing and drying would be beneficial.

SUMMARY

A new printing system includes an anti-curl fluid applicator that treats substrates to reduce the curling of the substrates caused by inkjet printing and drying. The system includes at least one printhead configured to eject drops of an aqueous ink, a substrate transport system configured to move substrates past the at least one printhead to enable the at least one printhead to eject drops of the aqueous ink onto the substrates to form aqueous ink images on the substrates, an anti-curl fluid applicator configured to apply anti-curl fluid to a side of the substrates opposite a side on which the at least one printhead forms aqueous ink images on the substrates, a pressure member having a plurality of electrically insulated segments arranged in a cross-process direction, the pressure member being positioned to form a nip with the anti-curl fluid applicator, and a switching network configured to independently and selectively apply electrical energy to the segments of the pressure member.

A new anti-curl fluid applicator that treats substrates in a printer to reduce the substrate curling caused by inkjet printing and drying. The method includes a pressure member having a plurality of electrically insulated segments arranged along a longitudinal axis of the pressure member in a cross-process direction, a reservoir configured to hold anti-curl fluid, an anilox roller, the anilox roller being positioned so a portion of the anilox roller rotates in the anti-curl fluid in the reservoir and another portion of the anilox roller forms a nip with the pressure member having the electrically insulated segments, and a switching network configured to independently and selectively apply electrical energy to the electrically insulated segments of the pressure member.

BRIEF DESCRIPTION OF THE DRAWINGS

The foregoing aspects and other features of a substrate treatment system that reduces the curling of the substrates in a printer are explained in the following description, taken in connection with the accompanying drawings.

DETAILED DESCRIPTION

Figure 1:
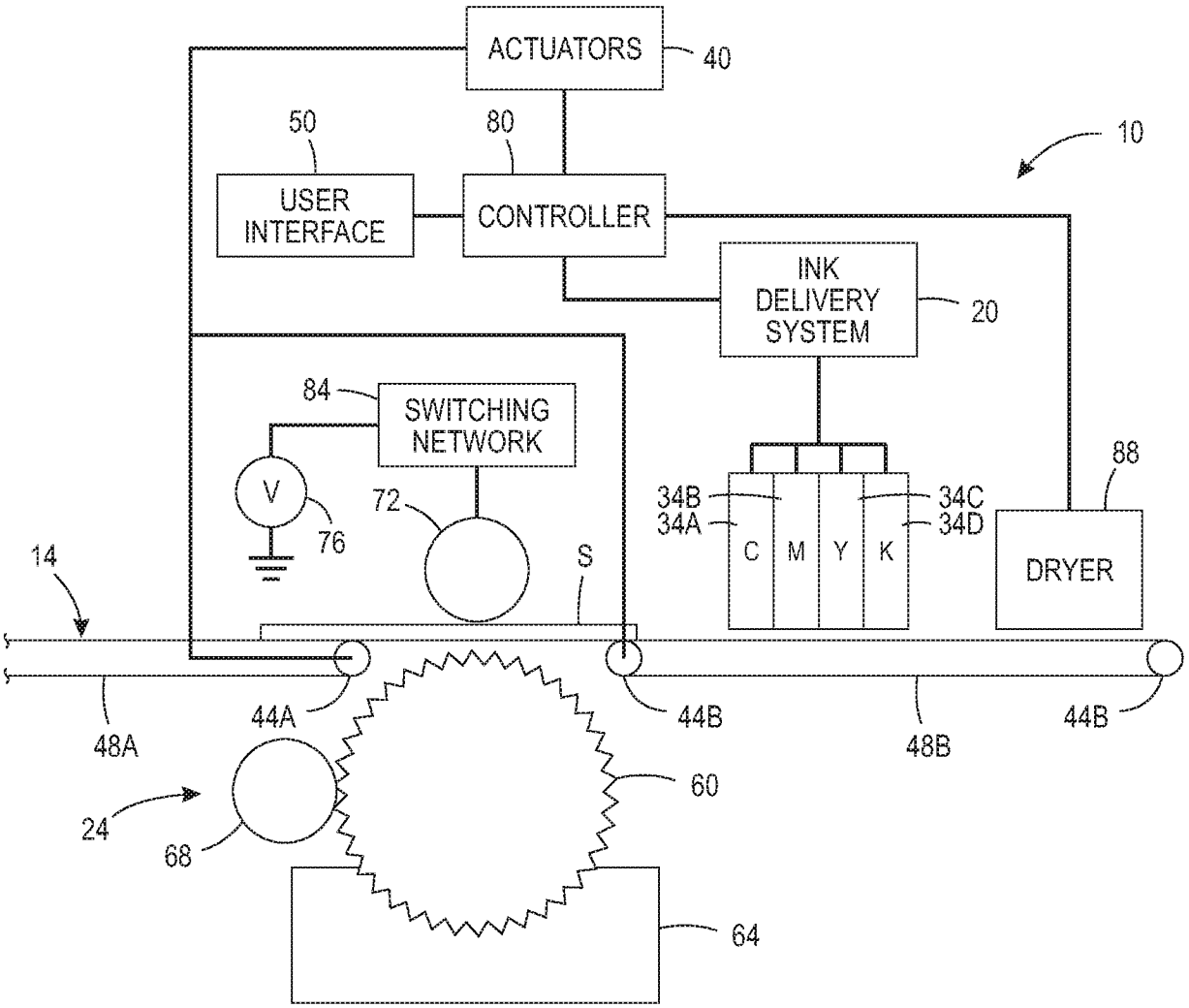
FIG. 1 is a block diagram of an aqueous ink printing system that enables efficient drying of aqueous ink images without appreciable additional complexity or significant increases in drying temperatures.

For a general understanding of the present embodiments, reference is made to the drawings. In the drawings, like reference numerals have been used throughout to designate like elements.

FIG. 1 illustrates a high-speed aqueous ink printing system or printer 10 that has been configured with an anti-curl fluid applicator 24 to attenuate curl induced in the substrates printed by the printer 10. As illustrated, the printer 10 directly forms an ink image on a surface of a substrate S transported through the printer 10 by a transport system 14. The transport system 14 includes an endless belt 48A that is wrapped about a pair of rollers 44A, one of which is shown in the figure, and another endless belt 48B that is wrapped about a pair of roller 44B. Controller 80 operates one of the actuators 40 that is operatively connected to at least one of the rollers 44A to rotate the endless belt 48A around the rollers to move the substrates into a nip within the anti-curl fluid applicator 24. Printhead modules 34A, 34B, 34C, and 34D are positioned opposite the another pair of rollers 44B and the another endless belt 48B to transport the substrates from the anti-curl fluid applicator 24 to the print zone opposite the printhead modules. In another embodiment, the anti-curl fluid applicator 24 is positioned between endless belts in the transport system 14 after the substrate S has been printed by the printhead modules. That is, the substrate S can be treated by anti-curl fluid applicator 24 either before or after being printed by the printhead modules.

The controller 80 receives data for an image to be formed on a substrate and renders that data into halftone data for operating the printhead or printheads within each printhead module in a known manner. The ejectors in the printheads eject drops of ink onto the substrate S as the substrate passes the printhead modules to form ink images on the substrate. In one embodiment, each printhead module has only one printhead that has a width that corresponds to a width of the widest media in the cross-process direction that can be printed by the printer. In other embodiments, the printhead modules have a plurality of printheads with each printhead having a width that is less than a width of the widest media in the cross-process direction that the printer can print. In these modules, the printheads are arranged in an array of staggered printheads that enables media wider than a single printhead to be printed. Additionally, the printheads can also be interlaced so the density of the drops ejected by the printheads in the cross-process direction can be greater than the smallest spacing between the inkjets in a printhead in the cross-process direction. Printer 10 can also be a printer that has a moving web rather than a transport system 14 so the web can move past the printheads for the printing of images on the web. As used in this document, the term "process direction" refers to the direction of substrate movement through the printer 10 and the term "cross-process direction" refers to a direction that is perpendicular to the process direction in the plane of the substrate.

The aqueous ink delivery subsystem 20 has at least one ink reservoir containing one color of aqueous ink for each printhead module. Since the illustrated printer 10 is a multicolor image producing machine, the ink delivery system 20 includes four (4) ink reservoirs, representing four (4) different colors CYMK (cyan, yellow, magenta, black) of aqueous inks. Each ink reservoir is connected to the printhead or printheads in a printhead module to supply ink to the printheads in the module. Pressure sources and vents of the delivery system 20 are also operatively connected between the ink reservoirs and the printheads within the printhead modules to perform manifold and inkjet purges. Additionally, although not shown in FIG. 1, each printhead in a printhead module is connected to a corresponding waste ink tank with a valve to enable the collection of purged ink during manifold and inkjet purge operations. The printhead modules 34A-34D can include associated electronics for operation of the one or more printheads by the controller 80 although those connections are not shown to simplify the figure. Although the printer 10 includes four printhead modules 34A-34D, each of which has two arrays of printheads, alternative configurations include a different number of printhead modules or arrays within a module. The controller 80 also operates the anti-curl fluid applicator 24 to treat the substrates either before or after printing to attenuate curl induced in the substrate by printing alone.

Operation and control of the various subsystems, components and functions of the machine or printer 10 are performed with the aid of a controller or electronic subsystem (ESS) 80. The ESS or controller 80 is operably connected to the components of the ink delivery system 20, the anti-curl fluid applicator 24, the printhead modules 34A-34D (and thus the printheads), and the actuators 40. The ESS or controller 80, for example, is a self-contained, dedicated mini-computer having a central processor unit (CPU) with electronic data storage, and a display or user interface (UI) 50. The ESS or controller 80, for example, includes a sensor input and control circuit as well as a pixel placement and control circuit. In addition, the CPU reads, captures, prepares and manages the image data flow between image input sources, such as a scanning system or an online or a work station connection, and the printhead modules 34A-34D. As such, the ESS or controller 80 is the main multi-tasking processor for operating and controlling all of the other machine subsystems and functions, including the printing process.

The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image data for an ink image to be produced are sent to the controller 80 from either a scanning system or an online or work station connection for rendering and generation of the printhead control signals output to the printhead modules 34A-34D and the signals that operate the anti-curl fluid applicator 24 to apply an anti-curl material to the substrate S. Additionally, the controller 80 determines and accepts related subsystem and component controls, for example, from operator inputs via the user interface 50 and executes such controls accordingly. As a result, aqueous ink for appropriate colors are delivered to the printhead modules 34A-34D.

The anti-curl fluid applicator 24 includes an anilox roller 60 that sits in a reservoir 64 containing anti-curl fluid. As used in this document, "an anilox roller" means a cylinder having a core of a hard material, usually constructed of steel or aluminum, which is coated by an industrial ceramic material having a surface containing millions of dimples, sometimes called cells. A metering roller 68 is positioned adjacent to the anilox roller 60 to press against the anilox roller to remove excess ink from the roller and return it to the reservoir. A pressure member 72 is positioned on the opposite side of the transport path from the anilox roller 60 to form a nip with the anilox roller through which the substrate S passes for application of the anti-curl fluid. The pressure member 72 is electrically connected to a voltage source 76 to electrically bias the pressure member 72. The voltage source can be a DC voltage source that alternates between electrical ground and a positive or negative voltage. Since the anilox roll is connected to electrical ground, the electrical field between the pressure member and the anilox roller can be modulated in both the process and cross-process directions to energize the pickup of the anti-curl fluid in the cells within the nip. Alternatively, the voltage source 76 can be an AC source. As shown in FIG. 1, the pressure member 72 is a roller but in other embodiments, an elongated elastomeric planar member, such as a blade member, is used instead of the pressure roller and it also includes electrically insulated segments across its length in the cross-process direction as described below for the roller.

Figure 2:
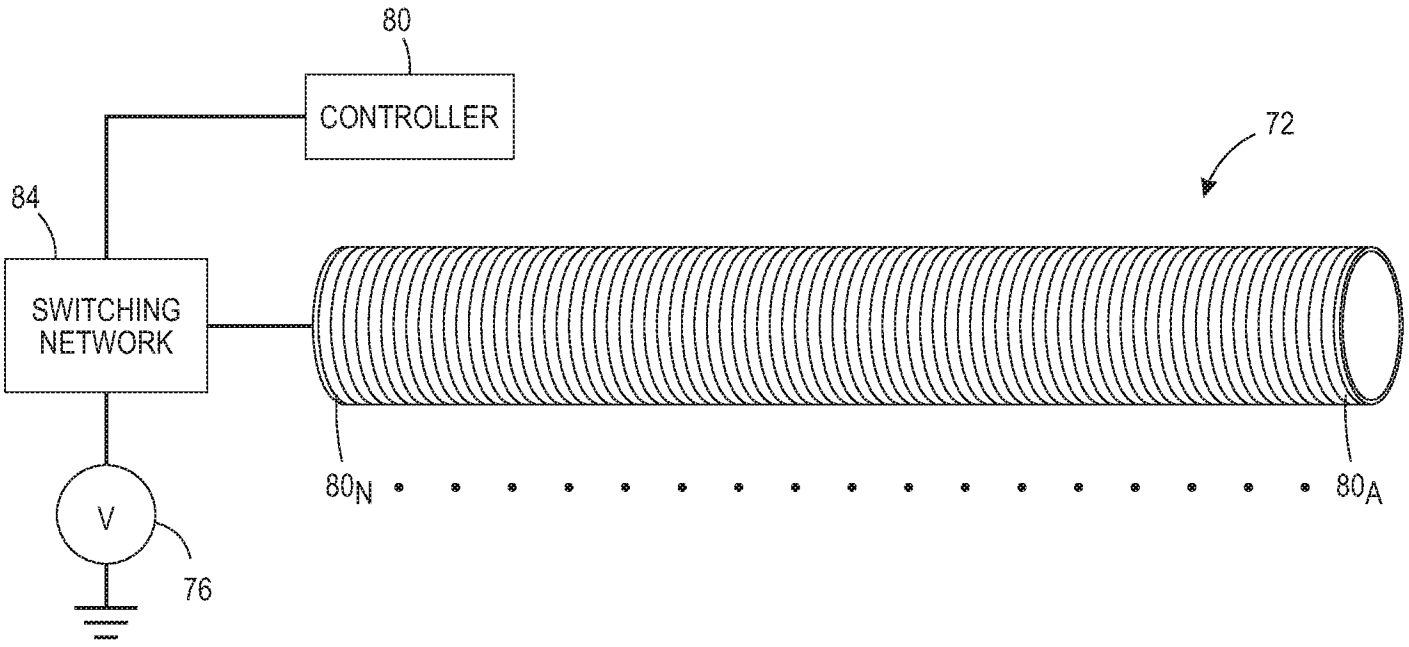
FIG. 2 is a view of a segmented pressure roller used as in the printing system of FIG. 1.

As shown in FIG. 2, the pressure member 72 is comprised of concentric segments 80A to 80N that are electrically insulated from one another so the segments can be independently connected to the voltage source 76. Within the internal volume of roller 72, each segment is electrically connected to an electrode and each electrode is independently connected to the voltage source 76 through a switching network 84. The controller 80 is operatively connected to the switching network 84 and is configured to operate the switches in the network 84 independently to connect the electrodes selectively to the voltage source 76 to electrically bias the segments independently of one another. The width of the segments provides an adequate spatial resolution in the cross-process direction for the anti-curl fluid to counteract curling on the portion of the substrate opposite the segment. The resolution in the process direction is controlled by the width of the nip between the anilox roller and the substrate along with the switching frequency of the electrical bias. In a practical design, the resolutions in both the process and cross-process directions are configured to be sufficiently high for adequate anti-curl fluid application. Typically, the segments are a few millimeters wide in the cross-process direction. In various embodiments, the width of the segments is in a range of about 1.0 mm to about 5.0 mm and in one particular embodiment, the segments are 2.0 mm in width. The controller can operate the switching network 84 at a rate that enables the portion of the pressure roller 72 contacting a portion of the substrate S in the nip to electrically bias an area that is about the width of a roller segment and a length of about the same distance. In one embodiment, the controller operates the ejectors at a rate of 40 kHz to produce 1200 dots per inch (dpi) in the process direction with the substrate moving at a speed of approximately 847 mm/second. By switching the network 84 at a rate of 333 Hz (40 kHz/120) the resolution of the anti-curl fluid delivery system is about 10 dpi in the process direction, which corresponds to about 2.54 mm (2.54 cm/100). Thus, an energized segment affects an area of the substrate that is about 2.54 mm by 2.0 mm. For the substrate speeds and ejection rates of current printers, the controller operates the switching network to produce a resolution of applied anti-curl fluid in a range of about 5.0 to about 25.0 dots per inch in the process direction. The controller identifies the segments to be electrically biased with reference to the image data used to operate the ejectors in the printheads. Specifically, the controller operates the switches for the roller segments that are contacting an area of the substrate that is on an opposite side of an area of the substrate that bears or will bear ink coverage sufficient to produce curl in the substrate.

The electrical biasing of a segment produces an electric field about the segment. The lines of the electric field cut through the substrate S and pull the anti-curl fluid toward the side of the substrate contacting the anilox roller 60. This attraction helps the anti-curl fluid migrate from the anilox roller to the substrate to wet the portion of the substrate S in the nip between the charged segments of the pressure roller 72 and the anilox roller 60 more effectively. The portions of the substrate S in the nip between uncharged segments and the anilox roller receive minimal or no anti-curl fluid. To generate an image that is used to control the switching network 84, the controller generates a halftone image for each color separation in the image to be printed. For each portion of the image that corresponds to the resolution of the image in the process image at the switching network frequency, such as 333 Hz as noted above, the number of drops to be ejected into that portion of the image is totaled and compared to a predetermined ink coverage threshold. If the number equals or exceeds the predetermined ink coverage threshold, a binary value that corresponds to electrically biasing the corresponding segment is placed in the switching network image. Otherwise, the other binary value is stored in that image. As used in this document, "portions of the image having sufficient ink to produce curl" means the areas having a sum of ink drops that exceeds the predetermined ink coverage threshold. The predetermined ink threshold is determined empirically and depends upon the type of substrate, the type of ink, and related parameters. This binary image is then used to electrically bias the segments as the substrate passes through the nip between the pressure member 72 and the anilox roller 60.

For duplex printing, the printed substrate moves past the printhead modules and the printed image is radiated by dryer 88 to remove water and other solvents from the ink on the substrate. As used in this document, the term "dryer" means any device configured to apply energy to a substrate to remove fluids from the substrate. Such dryers are known and can be implemented with convection heaters, microwave radiators, infrared radiators, and the like. The substrate is then turned over in a known manner, such as a reversing transport path or turn bar, and returned to the endless belt 48A. The dried image on the substrate now faces the anilox roller 60 when it enters the nip between the pressure member 72 and the anilox roller. Application of the anti-curl fluid to the dried image does not adversely impact the image quality of the dried image. The duplex image can then exit the printer or move to other components for further processing.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An aqueous ink printer comprising:

at least one printhead configured to eject drops of an aqueous ink;

a substrate transport system configured to move substrates past the at least one printhead to enable the at least one printhead to eject drops of the aqueous ink onto the substrates to form aqueous ink images on the substrates;

an anti-curl fluid applicator configured to apply anti-curl fluid to a side of the substrates opposite a side on which the at least one printhead forms aqueous ink images on the substrates;

a pressure member having a plurality of electrically insulated segments arranged in a cross-process direction, the pressure member being positioned to form a nip with the anti-curl fluid applicator; and a switching network configured to independently and selectively apply electrical energy to the segments of the pressure member.

2. The aqueous ink printer of claim 1 wherein the pressure member is an elongated elastomeric planar member.

3. The aqueous ink printer of claim 1 wherein the pressure member is a roller.

4. The aqueous ink printer of claim 1 wherein the switching network is further configured to independently and selectively apply DC electrical energy to the segments of the pressure member.

5. The aqueous ink printer of claim 4 wherein the switching network is further configured to independently and selectively apply the DC electrical energy to electrically bias the segments of the pressure member positively.

6. The aqueous ink printer of claim 4 wherein the switching network is further configured to independently and selectively apply the DC electrical energy to electrically bias the segments of the pressure member negatively.

7. The aqueous ink printer of claim 1 wherein the switching network is further configured to independently and selectively apply AC electrical energy to electrically bias the segments of the pressure member.

8. The aqueous ink printer of claim 1, the anti-curl fluid applicator further comprising:

a reservoir configured to hold anti-curl fluid;

an anilox roller, the anilox roller being positioned so a portion of the anilox roller rotates in the anti-curl fluid in the reservoir and another portion of the anilox roller forms the nip with the pressure roller having the segments.

9. The aqueous ink printer of claim 8, the anti-curl fluid applicator further comprising:

a metering roller configured to remove excess anti-curl fluid from the anilox roller before the portion of the anilox roller receiving anti-curl fluid from the reservoir engages the pressure member.

10. The aqueous ink printer of the claim 1 further comprising:

a controller operatively connected to the at least one printhead and the switching network, the controller being configured to operate the switching network to electrically bias the segments of the pressure member that correspond to areas of the substrates on which the at least one printhead produces ink coverage sufficient to produce curl that are within the nip between the pressure member and the anti-curl fluid applicator.

11. The aqueous ink printer of claim 10 wherein the controller operates the switching network at a rate that corresponds to a range of about 5.0 drops to about 25.0 drops per inch in the process direction.

12. The aqueous ink printer of claim 10, the controller being further configured to:

render data for an image to be formed on a substrate and generate halftone data for the image; and generate a binary image for operating the switching network.

13. The aqueous ink printer of claim 12, the controller being further configured to:

identify a total number of ink drops to be ejected into an area of an ink image on the substrate;

compare the total number of ink drops for the area to a predetermined solid area ink coverage threshold; and store a binary value that indicates a switch in the switching network is operated to connect one of the segments to the voltage source in the binary image at a position corresponding to the area.

14. The aqueous ink printer of claim 1 wherein the segments of the pressure roller each have a width in the range of about 1.0 to about 5.0 mm in the cross-process direction.

15. The aqueous ink printer of claim 1 wherein the at least one printhead is positioned to form ink images on the substrates before the substrates enter the nip between the pressure member and the anti-curl applicator.

16. The aqueous ink printer of claim 1 wherein the at least one printhead is positioned to form ink images on the substrates after the substrates enter the nip between the pressure member and the anti-curl applicator.

17. The aqueous ink printer of claim 1 further comprising:

a dryer; and a device configured to reverse the substrates after the substrates have been treated by the dryer so the anti-curl fluid applicator applies anti-curl fluid to the dried ink images when the substrates enter the nip between the pressure member and the anilox roller.

18. An anti-curl fluid applicator comprising:

a pressure member having a plurality of electrically insulated segments arranged along a longitudinal axis of the pressure member in a cross-process direction;

a reservoir configured to hold anti-curl fluid;

an anilox roller, the anilox roller being positioned so a portion of the anilox roller rotates in the anti-curl fluid in the reservoir and another portion of the anilox roller forms a nip with the the pressure member having the electrically insulated segments; and a switching network configured to independently and selectively apply electrical energy to the electrically insulated segments of the pressure member.

19. The anti-curl fluid applicator of claim 18 wherein the pressure member is an elongated elastomeric planar member.

20. The anti-curl fluid applicator of claim 19 wherein the pressure member is a roller.

21. The anti-curl fluid applicator of claim 18 further comprising:

a metering roller configured to remove excess anti-curl fluid from the anilox roller before the portion of the anilox roller receiving anti-curl fluid from the reservoir engages the pressure member.

* * * * *